US007555855B2

(12) United States Patent
Alshaer et al.

(10) Patent No.: US 7,555,855 B2
(45) Date of Patent: Jul. 7, 2009

(54) AUTOMATIC DIGGING AND LOADING SYSTEM FOR A WORK MACHINE

(75) Inventors: Bassam Jameel Alshaer, Peoria, IL (US); Richard G. Ingram, St. Charles, IL (US); John James Krone, Peoria, IL (US); Jeffrey Kent Berry, Peoria, IL (US); Jared James Harris, Sahuarita, AZ (US)

(73) Assignee: Caterpillar Inc., Peoria, IL (US)

( * ) Notice: Subject to any disclaimer, the term of this patent is extended or adjusted under 35 U.S.C. 154(b) by 432 days.

(21) Appl. No.: 11/094,527

(22) Filed: Mar. 31, 2005

(65) Prior Publication Data

US 2006/0245896 A1 Nov. 2, 2006

(51) Int. Cl.
*G05D 1/02* (2006.01)
*G05B 19/02* (2006.01)

(52) U.S. Cl. ..... 37/382; 37/414; 701/50

(58) Field of Classification Search ..... 37/348, 37/382, 414, 416; 414/699, 718; 701/50; 172/2, 811

See application file for complete search history.

(56) References Cited

U.S. PATENT DOCUMENTS 4,518,044 A 5/1985 Wiegardt et al.
4,608,873 A 9/1986 Redzinski
4,984,956 A 1/1991 Ikari et al.
5,000,650 A * 3/1991 Brewer et al. ..... 414/699
5,065,326 A 11/1991 Sahm
5,105,895 A 4/1992 Kyrtsos
5,116,187 A * 5/1992 Fukuda et al. ..... 414/699
5,193,637 A 3/1993 Lindblom
5,214,916 A 6/1993 Luckich
5,438,771 A 8/1995 Sahm et al.
5,446,980 A 9/1995 Rocke
5,461,803 A 10/1995 Rocke
5,493,798 A 2/1996 Rocke et al.
5,528,843 A 6/1996 Rocke
5,682,312 A 10/1997 Rocke
5,720,358 A 2/1998 Christensen et al.
5,794,369 A 8/1998 Lee et al.
5,899,008 A * 5/1999 Cobo et al. ..... 37/348
5,941,921 A 8/1999 Dasys et al.
5,950,141 A 9/1999 Yamamoto et al.
5,968,103 A 10/1999 Rocke
5,974,352 A 10/1999 Shull
5,975,214 A 11/1999 Okamura et al.
5,987,371 A 11/1999 Bailey et al.

(Continued)

*Primary Examiner*—Thomas A Beach
(74) *Attorney, Agent, or Firm*—Finnegan, Henderson, Farabow, Garrett & Dunner

(57) ABSTRACT

An automatic loading control system for loading a work implement of a work machine with material from a pile may include a lift sensor configured to monitor a lift actuator and communicate a lift signal. The system may also include a tilt sensor configured to monitor a tilt actuator and communicate a tilt signal. A speed sensor may be configured to communicate a speed signal indicative of a speed of the work machine. A control module may be configured to receive the lift signal, the tilt signal, and the speed signal and generate a signal to control a rim-pull based on at least one of a lift velocity of the lift actuator, a tilt velocity of the tilt actuator, and a work machine velocity to facilitate movement of the work implement through the pile.

36 Claims, 7 Drawing Sheets

U.S. PATENT DOCUMENTS

| | | | | |
|---|---|---|---|---|
| 5,994,865 | A | 11/1999 | Phelps et al. | |
| 6,032,093 | A | 2/2000 | Denbraber et al. | |
| 6,047,228 | A * | 4/2000 | Stone et al. | 701/50 |
| 6,064,933 | A | 5/2000 | Rocke | |
| 6,065,904 | A | 5/2000 | Cook et al. | |
| 6,108,949 | A | 8/2000 | Singh et al. | |
| 6,129,155 | A | 10/2000 | Lombardi et al. | |
| 6,131,061 | A | 10/2000 | DenBraber et al. | |
| 6,140,787 | A | 10/2000 | Lokhorst et al. | |
| 6,167,336 | A | 12/2000 | Singh et al. | |
| 6,205,687 | B1 | 3/2001 | Rocke | |
| 6,208,925 | B1 * | 3/2001 | Creger et al. | 701/51 |
| 6,211,471 | B1 * | 4/2001 | Rocke et al. | 177/136 |
| 6,234,254 | B1 * | 5/2001 | Dietz et al. | 172/3 |
| 6,246,939 | B1 * | 6/2001 | Nozawa | 701/50 |
| 6,278,955 | B1 | 8/2001 | Hartman et al. | |
| 6,282,453 | B1 | 8/2001 | Lombardi | |
| 6,286,606 | B1 | 9/2001 | Krieg et al. | |
| 6,321,153 | B1 * | 11/2001 | Rocke et al. | 701/50 |
| 6,371,214 | B1 | 4/2002 | Anwar et al. | |
| 6,385,519 | B2 * | 5/2002 | Rocke | 701/50 |
| 6,584,710 | B1 | 7/2003 | Lin et al. | |
| 6,591,591 | B2 | 7/2003 | Coers et al. | |
| 6,845,311 | B1 * | 1/2005 | Stratton et al. | 701/50 |
| 6,879,899 | B2 * | 4/2005 | Budde | 701/50 |
| 7,121,355 | B2 * | 10/2006 | Lumpkins et al. | 172/4.5 |
| 2004/0117092 | A1 | 6/2004 | Budde | |
| 2008/0255735 | A1 * | 10/2008 | Marathe et al. | 701/50 |

* cited by examiner

AUTOMATIC DIGGING AND LOADING SYSTEM FOR A WORK MACHINE

TECHNICAL FIELD

This disclosure is directed to a digging and loading system and, more particularly, this disclosure is directed to an automatic digging and loading system for a work machine.

BACKGROUND

Some work machines are useful to repetitiously perform processes of digging and loading. For example, a work machine, such as a wheel loader, may repetitively load material into its bucket and dump the material into the bed of a truck. Often, the repetitious work cycle can become tedious to an operator and the operator may become fatigued. As the fatigue sets in, the operator may work less efficiently, thereby adversely impacting the efficiency of the work machine.

To reduce operator fatigue and maintain a high level of machine productivity and efficiency, some work machines are equipped with controllers that automate portions of the repetitive work process. These controllers typically rely upon measured cylinder pressures and positions to determine when to implement an action or a step to load the bucket of the work machine. While these pressure and position measurements may be useful when loading an aggregate, such as gravel or sand that is loosely piled, such systems are less useful when digging hard materials. When digging and loading materials with different digging toughness and shapes, some work machines may require that an operator tune or otherwise adjust the work machine to compensate for the digging toughness.

One example of a system for automatically digging and loading is disclosed in U.S. Patent Publication No. 2004/0117092. The system disclosed in the publication may be used to efficiently perform a repetitive motion, such as digging and loading with the work machine. Nevertheless, the system may be improved upon. For example, while the system disclosed in the publication provides for adjustment of lift and tilt commands based upon variations in a monitored ground speed, it may not provide for adjustment of speed based on velocities of the lift and tilt actuators. Further, such a system may still require tuning and adjustment when loading piles of materials having differing densities and materials.

This disclosure is directed to an automatic control system and method that overcomes one or more of the disadvantages of the prior art.

SUMMARY OF THE INVENTION

In one exemplary aspect, the present disclosure is directed toward an automatic loading control system for loading a work implement of a work machine with material from a pile. The system may include a lift sensor configured to monitor a lift actuator and communicate a lift signal. The system may also include a tilt sensor configured to monitor a tilt actuator and communicate a tilt signal. A speed sensor may be configured to communicate a speed signal indicative of a speed of the work machine. A control module may be configured to receive the lift signal, the tilt signal, and the speed signal and generate a signal to control a rim-pull based on at least one of a lift velocity of the lift actuator, a tilt velocity of the tilt actuator, and a work machine velocity to facilitate movement of the work implement through the pile.

In another exemplary aspect, a method of controlling an automatic bucket control system for loading a work implement of a work machine with material from a pile is disclosed. The method may include monitoring a lift actuator and communicating a lift signal. The method may also include monitoring a tilt actuator and communicating a tilt signal. A speed signal indicative of a speed of the work machine may be communicated, and a signal may be generated to control a rim-pull based on at least one of a lift velocity of the lift actuator, a tilt velocity of the tilt actuator, and a work machine velocity to facilitate movement of the work implement through the pile.

In yet another exemplary aspect, an automatic loading control system for loading a work implement of a work machine may include a lift sensor configured to monitor a lift actuator and communicate a lift signal. The loading control system may also include a tilt sensor configured to monitor a tilt actuator and communicate a tilt signal. A speed sensor may be configured to communicate a speed signal indicative of a speed of the work machine. A control module may be configured to receive the lift signal, the tilt signal, and the speed signal and generate a control signal to repetitively increase and decrease at least one of a lift velocity and a tilt velocity of the work implement to facilitate entry of the work implement into a pile of material while loading the work implement.

DETAILED DESCRIPTION

Reference will now be made in detail to exemplary embodiments that are illustrated in the accompanying drawings. Wherever possible, the same reference numbers will be used throughout the drawings to refer to the same or like parts. While specific configurations and arrangements are discussed, it should be understood that this is done for illustrative purposes only.

Figure 1:
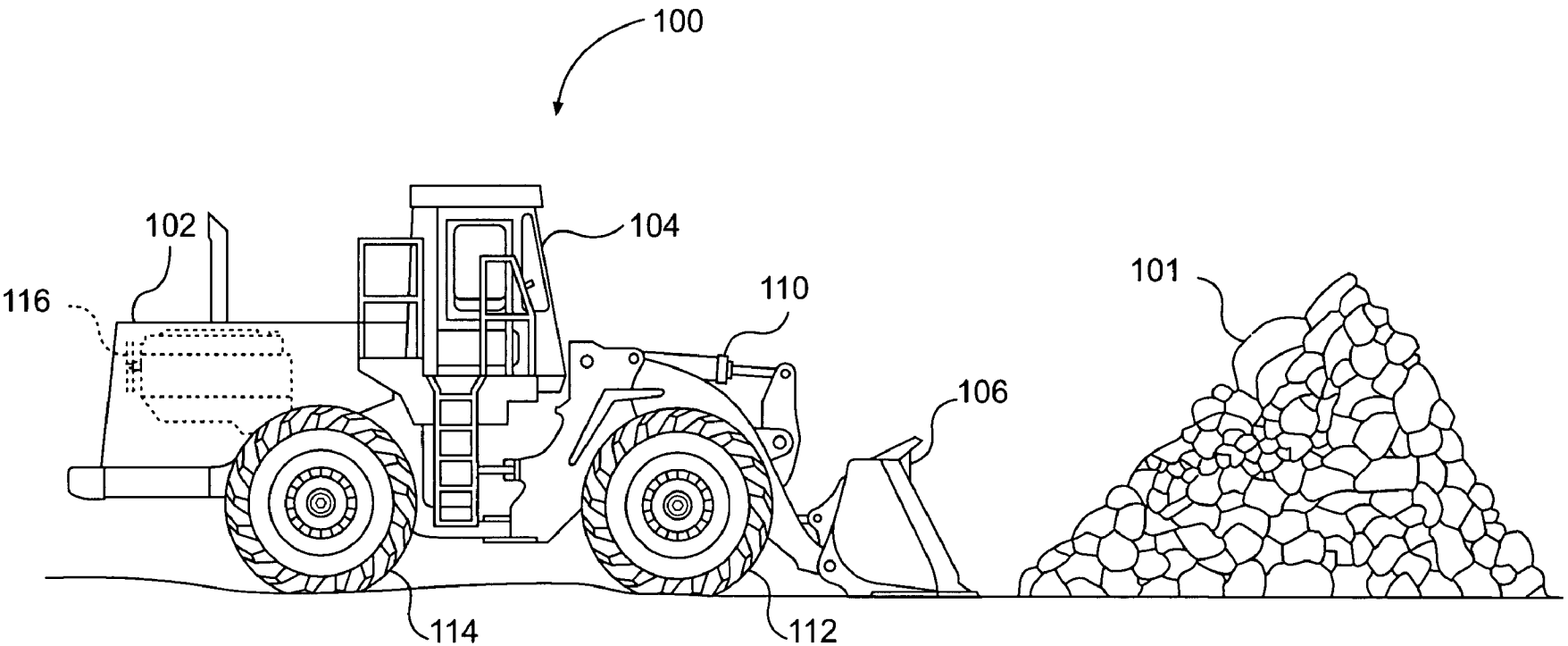
FIG. 1 is a diagrammatic illustration of an exemplary work machine.

Referring to FIG. 1, a work machine 100 is illustrated approaching a pile of material 101. The work machine 100 may include an engine housing 102, an operator station 104, and a work implement 106, such as, for example, a bucket for digging and loading material. In the example of work machine 100 being a wheel loader, the work implement 106 is powered and controlled by a lift actuator 108 (shown in the block diagram of FIG. 2) and a tilt actuator 110. The lift and tilt actuators 108, 110 may be, for example, hydraulic fluid cylinder actuators. However, the lift and tilt actuators 108, 110 could be other actuators, as would be apparent to one skilled in the art.

The work machine 100 may include ground engaging devices, such as front wheels 112 and rear wheels 114, that support the work machine 100. The engine housing 102 may include an engine 116 that may be configured to drive a transmission 118 (shown in the block diagram of FIG. 2) that may provide power to the front and/or rear wheels 112, 114. While a wheeled work machine is shown and described, one skilled in the art will appreciate that other work machines, including track-type work machines, may also be utilized.

The pile of material 101 may be any of a variety of materials that are to be loaded into the work implement 106 and dumped at another location. For example, the pile 101 may include gravel, sand, dirt, and the like. Alternatively, the pile 101 may be an embankment or hill formed of a tough material, such as clay, embedded rocks, or other tough material. Of course, the work machine 100 may encounter any number of variations in piles of material to be loaded during its course of operation. It is understood that the reference to piles of material encompasses any material to be loaded.

Figure 2:
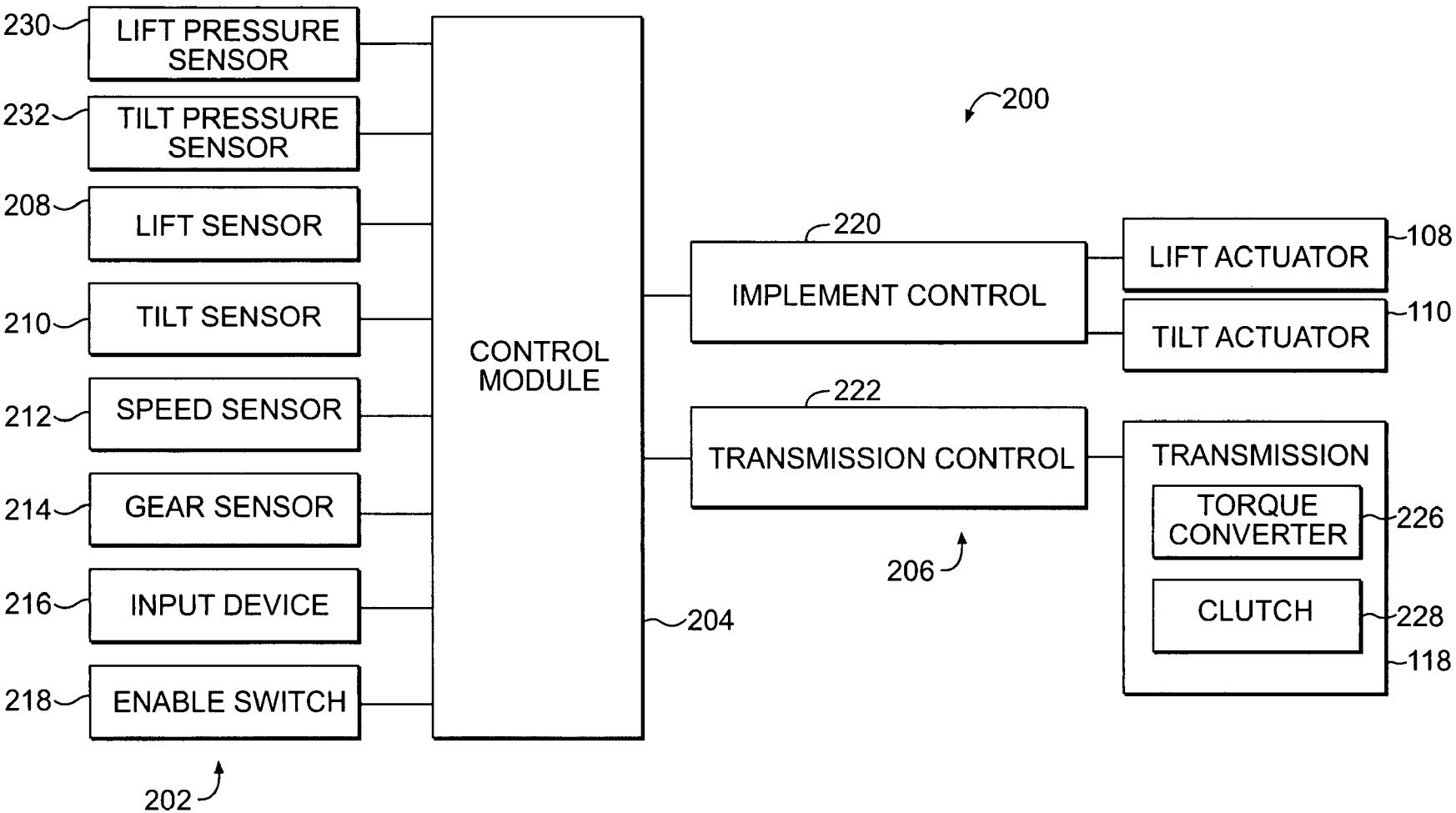
FIG. 2 is a block diagram of an exemplary control system for the work machine of FIG. 1.

FIG. 2 is a block diagram of a control system 200 that may be utilized on the work machine 100 for operation and control. The control system 200 may include a velocity based digging and loading system configured to load the work implement 106 of the work machine 100. The control system 200 may include input elements 202, a control module 204, and controllers 206. The input elements 202 may include a lift sensor 208, a tilt sensor 210, a speed sensor 212, a gear sensor 214, an input device 216, an enable switch 218, a lift pressure sensor 230, and a tilt pressure sensor 232.

The lift sensor 208 and the tilt sensor 210 may be configured in a manner to detect a position of the lift and tilt actuators 108, 110, respectively, and/or other information that may be used to determine a velocity of the lift and tilt actuators 108, 110. In one exemplary embodiment, the lift and tilt sensors 208, 210 are associated with the lift and tilt actuators 108, 110, while in another exemplary embodiment, the lift and tilt sensors 208, 210 are associated directly with the linkage and/or bucket that is actuated by the lift and tilt actuators 108, 110. The lift and tilt sensors 208, 210 may be, for example, position sensors which measure the cylinder rod extension of the respective actuators. Alternatively, lift and tilt sensors 208, 210 may be rotary sensors, such as rotary potentiometers, configured to determine a relative angular position of the linkage or bucket. In yet another exemplary embodiment, the lift and tilt sensors 208, 210 directly monitor and detect the velocity of extension or retraction of the lift and tilt actuators 108, 110. As will be appreciated by those of ordinary skill in this art, the left and tilt sensors can comprise any of a number of measurement devices selected in accordance with the particular requirements of the application, including any one or combination of the above described devices.

The speed sensor 212 may be configured to detect a speed of the work machine 100 by monitoring any work machine component that may be indicative of the speed or velocity of the work machine. For example, the speed sensor 212 may monitor the engine speed of the engine 116 on the work machine 100. In other examples, the speed sensor 212 may monitor the transmission output speed or the wheel rotation. Other systems and methods may be used to monitor the speed of the work machine. The speed sensor 212 may be configured to communicate a signal indicative of the machine speed of the work machine 100.

A gear sensor 214 may be associated with the transmission 118 of the work machine 100 and may be configured to detect the operating gear of the transmission 118. The gear sensor 214 may be any sensor known in the art for providing such information. The gear sensor 214 may be configured to communicate a signal indicative of the operating gear of the work machine 100.

The input device 216 may be disposed within the operator station 104 for interfacing between an operator and the work machine 100. In one exemplary embodiment, the input device 216 is a series of levers that may be manually manipulated by the operator to control the work machine 100. The input device 216 may be any known input mechanism including, for example, a lever, joystick, dial, steering wheel, pedal, or other device.

The enable switch 218 also may be disposed within the operator station 104 of the work machine 100. The enable switch 218 may be an on-off switch configured to activate the digging and loading system. In one exemplary embodiment, the enable switch is a toggle switch that may be manually switched by the operator to turn the digging and loading system on and off.

The lift pressure sensor 230 and the tilt pressure sensor 232 may be associated with the lift actuator 108 and the tilt actuator 110 in a manner to detect a pressure of fluid within the lift and tilt actuators 108, 110, respectively. In one exemplary embodiment, the pressure sensors 230, 232 may be disposed within heads of the lift and tilt actuators 108, 110. It should be noted that the pressure sensors 230, 232 could be disposed at other locations about the lift and tilt actuators 108, 110 and about a hydraulic system associated with the lift and tilt actuators 108, 110.

The control module 204 may include a processor and a memory device, the latter of which may store one or more control routines, which could be software programs, for controlling the work machine 100 to carry out the velocity based digging and loading process. The control module 204 may be in communication with each of the input elements 202 and may be configured to receive and process signals from the input elements 202. Accordingly, signals indicative of information from the input elements 202 may be used by the control module 204 to perform processes or sequences, such as the velocity based digging and loading process. The control module 204 also may be configured to generate control signals that may be sent to the controllers 206. The control signals may be calculated or determined based upon the signals from the input elements 202.

For purposes of this disclosure, a command from the control module 204 to actuate the lift actuator 108 is referred to herein as a lift command. Similarly, a command from the control module 204 to actuate the tilt actuator 110 is referred to herein as a tilt command. In one exemplary embodiment, the lift and tilt commands control the percentage that valves are open, thereby regulating fluid flow to and from the lift and tilt actuators 108, 110. These commands may range from a minimum or zero % command, which may provide no movement or minimal movement to the actuators, up to a maximum or 100% command, which may provide the highest amount of movement of the actuators. As set forth below, the commands from the control module 204 may be or may not be based upon measured feedback that may be detected by any of the sensors described herein.

The controllers 206 may include an implement control 220 and a transmission control 222. The controllers 206 may be configured to receive the control signal from the control module 204, and operate a respective component of the work machine 100. In this exemplary embodiment, the implement control 220 may be configured to control the valves that regulate fluid flow, and therefore, the operation of the lift and tilt actuators 108, 110, as explained above. The transmission control 222, likewise, may be configured to control the transmission 118 of the work machine 100.

As shown in FIG. 2, the transmission 118 may include a torque converter 226 and a clutch 228. In one exemplary embodiment, the clutch is an impeller clutch. The clutch 228 may be configured to control rim-pull on the work machine 100. As used herein, rim-pull is meant to include the power or drive torque between the wheels and the ground. For example, increasing the rim-pull is meant to mean increasing the forward force of the work machine 100 as transferred from the wheels to the ground. In one exemplary embodiment, this may be accomplished by regulating the percentage of clutch engagement. In another exemplary embodiment, this may be accomplished by increasing engine speed. Other methods and systems for increasing rim-pull also may be implemented. In contrast, decreasing the rim-pull is meant to mean decreasing the forward or horizontal force of the work machine as transferred from the wheels to the ground. Again, this may be accomplished by regulating the percentage of clutch engagement or through other methods or systems as described above.

FIGS. 3 through 7 disclose one exemplary method of implementing the velocity based digging and loading system. This exemplary method may be a control sequence that may include several different phases or states of the overall digging and loading system. These phases may include an idle phase, a penetrating phase, a loading phase, a finish-lift phase, and a finish-tilt phase. Together, these phases may constitute the control sequence for the digging and loading system. Nevertheless, it is contemplated that the digging and loading system may include less than all of these phases or more phases than are disclosed herein. It should be noted that the control module 204 may be configured to repetitively advance through the control sequence of the digging and loading system, providing different responses when certain conditions are met. For example, in one embodiment, the control module 204 is configured to advance through the control sequence at least once every 20 milliseconds.

As will become apparent from the following disclosure, the idle phase is the active phase when the machine is not engaged in a pile of material during a digging and loading cycle. Accordingly, during the idle phase, the control module 204 may send operator generated commands to the machine controllers 206. The penetrating phase may represent the initial engagement between the work machine 100 and the material to be loaded. During this stage, the control module 204 may initiate a lift command to the lift actuator and may minimize a tilt command to the tilt actuator in order to transfer pile resistant forces into traction forces and prevent tire slippage. The loading phase may represent full engagement between the work machine 100 and the material in the pile. During the loading phase, the control module 204 may initiate lift, tilt, and rim-pull commands as needed, in order to keep the work machine moving and loading. The finish-lift phase ensures that the extension of the lift actuator 108 is properly utilized. The finish-tilt phase represents the end of the digging sequence and helps center a load in the work implement 106 of the work machine 100, thereby preventing spills.

For purposes of explanation, each different phase of the exemplary control sequence is included on a separate flow diagram. Accordingly, the idle phase is shown and disclosed with reference to FIG. 3; the penetrating phase is shown and disclosed with reference to FIG. 4; the loading phase is shown and disclosed with reference to FIG. 5; the finish-lift phase is shown and disclosed with reference to FIG. 6; and the finish-tilt phase is shown and disclosed with reference to FIG. 7.

Figure 3:
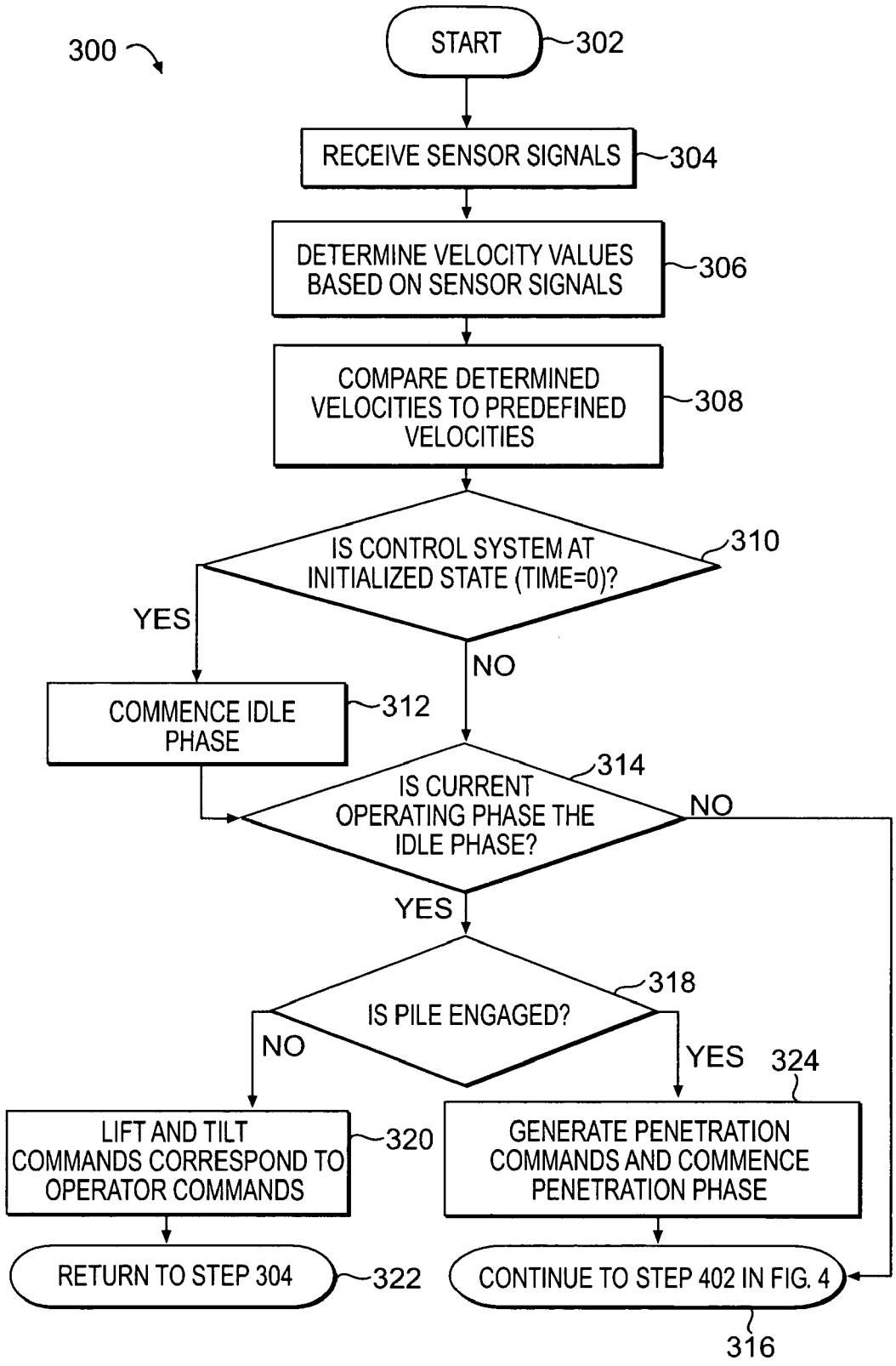
FIG. 3 is a flow diagram showing an idle phase of an exemplary control sequence of a method of digging and loading.

Turning to FIG. 3, a flow diagram 300 shows an exemplary idle phase of the control sequence of the velocity based digging and loading system. The flow diagram begins at a step 302. The control sequence may be activated by the enable switch 218. For example, when the enable switch 218 is in an off position, the digging and loading system may be in an inoperable phase and the work machine 100 may be configured to be controlled solely by operator inputs through the input device 216. However, when the enable switch 218 is in the on position, the digging and loading system may be operable. Therefore, the work machine 100 may be responsive to automatic control, as well as operator control. In one exemplary embodiment, the control sequence is designed in a manner that allows a work machine operator to manually override the control sequence at any time throughout the sequence. For example, the work machine operator may manipulate the input device 216 at any time throughout the sequence, and the control module 204 may execute the operator command and exit the control sequence. When the enable switch is on, the control module 204 may receive sensor signals at a step 304. The sensor signals may be received from, for example, the lift sensor 208, the tilt sensor 210, the speed sensor 212, and/or the gear sensor 214.

At a step 306, the control module 204 may determine current velocity values for the lift actuator 108, the tilt actuator 110, and the work machine 100, based on the signals from the lift sensor 208, the tilt sensor 210, and the speed sensor 212. In one exemplary embodiment, when the lift and tilt sensors 208, 210 detect the position of the associated lift and tilt actuators 108, 110, the control module 204 is configured to determine the current velocity based upon the rate of change. It should be noted that in other exemplary embodiments, the lift sensor 208, the tilt sensor 210, and the speed sensor 212 may each directly monitor the velocity of the associated component. In such an embodiment, the control module may receive signals indicative of the velocities, and may not perform calculations to determine velocity.

At a step 308, the determined velocity values may be compared to predefined velocity values stored within the control module 204. These predefined velocity values may be values determined based on testing, algorithms, and/or other data stored within the control module 204, and may be representative of desired or target values. The comparison between the determined and the predefined velocities may be used to activate stages and features of the control sequence, as will become apparent in the below disclosure of the various phases.

At a step 310, the control module may query whether the control system 200 is at an initialized state. As used herein, an initialized state is meant to mean that the sequence for the digging and loading system is at its beginning, such as, for example, a time counter of the digging and loading system is equal to zero. It should be noted that the initialized state need not correspond to the control sequence activation described at step 302, although in some exemplary embodiments, the initialized state could correspond to the control sequence activation.

If the control system 200 is at an initialized state at step 310, then the control system 200 commences the idle phase of the control sequence at a step 312. As explained above, the idle phase is the first phase of the digging and loading cycle. From step 312, or alternatively, if the control system 200 is not at an initialized state at step 310, the control module 204 queries whether the current operating phase is the idle phase, at a step 314. If the current operating phase is not the idle phase, then the method advances to step 402 in FIG. 4, as indicated at step 316 in FIG. 3. As discussed above, FIG. 4 represents the load phase.

If at step 314 the current operating phase is the idle phase, then the control module 204 determines whether the work implement 106 of the work machine 100 has engaged a pile of material, at a step 318. This determination may be made based upon one or more factors, which may include the position of the work implement 106 relative to the ground, whether the work implement 106 is substantially level, whether the work machine 100 has a decreasing velocity, and whether the input device 216 is in a neutral state. In addition, the control module 204 may consider whether the operating gear is a first gear, whether a torque level is increasing, and whether the pressure value in the lift and tilt actuators is increasing. After considering one or more of these factors at step 318, the control module 204 may determine whether the pile is engaged.

If the pile is not engaged, then at step 320, any lift and tilt commands sent from the control module 204 to the controllers 206 are based upon signals from the input device 216. Therefore, the automated digging and loading system is initialized, yet is being overridden by commands manually input by the operator. Accordingly, at a step 322, the system returns to step 304, and repeats the process.

If at step 318, the control module 204 determines that the work implement 106 has engaged the pile of material, then the control module 204 generates penetration commands and commences the penetration phase at a step 324. The penetration commands may include, for example, generating a tilt command that is zero, providing minimal movement, and generating a lift command corresponding to a pre-determined value, such as a maximum command. Other lift and tilt commands could also be used. Raising the work implement 106 with the lift command results in the work machine 100 bearing some of the weight of the load, thereby applying weight onto the tires, and thereby potentially reducing tire slip. The method then continues to step 316, which directs the control sequence to step 402 in FIG. 4.

Figure 4:
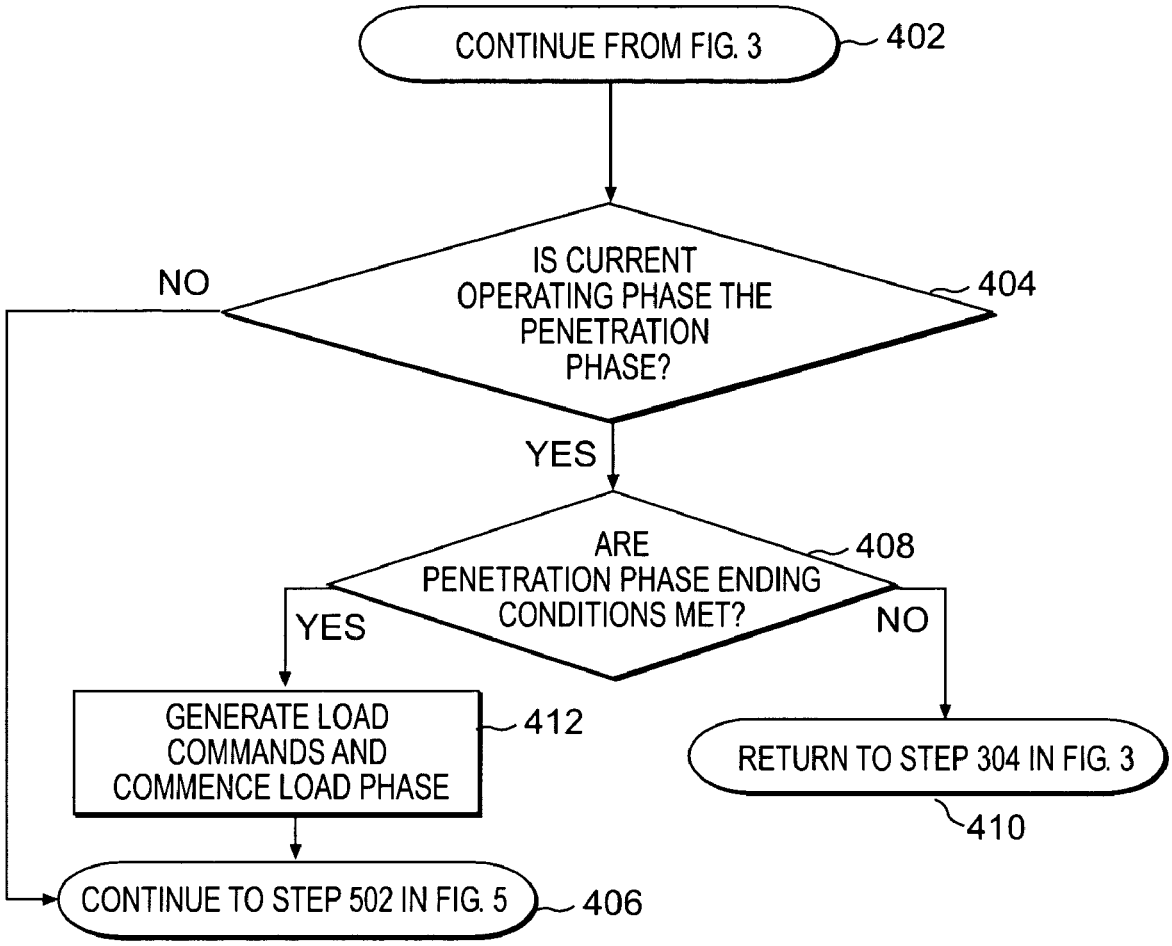
FIG. 4 is a flow diagram showing a penetration phase of the exemplary control sequence of the method of digging and loading.

The sequence then commences the penetration phase described with reference to FIG. 4. At a step 402 in FIG. 4, the sequence continues from FIG. 3. At a step 404, the control module 204 determines whether the current operating phase is the penetration phase. If the current phase is not the penetration phase, then at step 406, the sequence advances to step 502 of FIG. 5. However, if the current phase is the penetration phase at step 404, then the control module 204 determines whether the penetration phase ending conditions are being met, at a step 408. The ending conditions for the penetration phase may include, for example, extension of the lift actuator 108 beyond a threshold amount or, alternatively, may include passage of a pre-designated amount of time since the penetration phase began. This time limit for the penetration phase may be useful when the lift actuator 108 does not actually provide lift despite the lift command. This may occur when the pile is exceptionally tough or rigid and resistance to lift is greater than or substantially impedes the lift. Accordingly, after a pre-designated amount of time, the penetration phase ending conditions still would be met.

If the penetration phase ending conditions are not met at step 408, then the method at step 410 returns to step 304 in FIG. 3, and begins the sequence again. If at step 408, however, the penetration phase ending conditions are met, then the control module 204 may generate load phase commands and may commence the load phase, as indicated at step 412. The load commands may include, for example, generating a pre-established tilt command, such as a maximum tilt command, and generating a pre-established lift command, such as a minimum or zero lift command. Other pre-established commands could be used. Once the sequence has commenced the load phase at step 412, the method proceeds to the step 406, which is a step of continuing to step 502 in FIG. 5.

Figure 5:
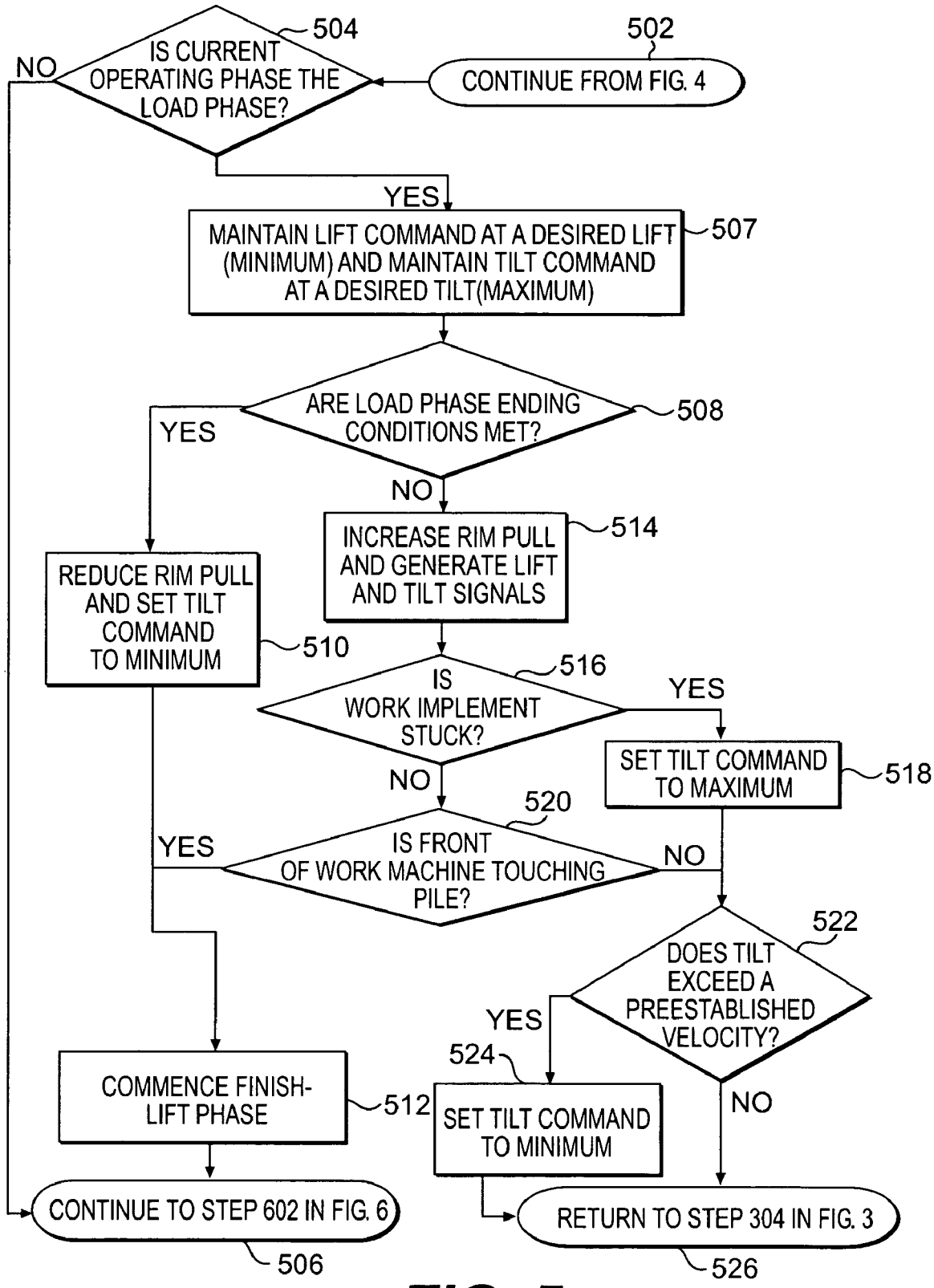
FIG. 5 is a flow diagram showing a load phase of the exemplary control sequence of the method of digging and loading.

FIG. 5 discloses the load phase for the method of digging and loading. At a step 502, the method continues from FIG. 4. At a step 504, the control module 204 queries whether the current operating phase is the load phase. If at step 504, the current operating phase is not the load phase, then the control module 204 advances the method sequence to step 506, which includes continuing to step 602 in FIG. 6. If however, at step 504, the current operating phase is the load phase, then the control module 204, at a step 507, may maintain the pre-established lift and tilt commands established at step 412.

At a step 508, the control module 204 determines whether the load phase ending conditions are met. This determination may depend upon the position or extension amount of the lift and/or tilt actuators 108, 110. For example, the control module 204 may compare the measured position of the lift and tilt actuators 205, 206 to pre-established positions to determine whether the load phase ending conditions are met. The load-phase ending conditions may be indicative of a fully-loaded work implement, or may indicate that the work implement is out of position for further loading.

If at step 508, the load phase ending conditions are met, then the control module 204 may reduce the rim-pull and generate a pre-designated tilt command, such as a minimum tilt, at a step 510. The rim-pull reduction may be accomplished by controlling the clutch 228 within the transmission 118. The clutch 228 may be controlled to reduce the power transfer from the engine 116 to the transmission 118, thereby reducing or eliminating the forward driving force applied to the wheels 112, 114, and likewise reducing the forward or driving force into the pile. Other methods and systems may also be used to reduce the rim-pull. Reducing the rim-pull may reduce the horizontal forces against the work implement 106, thereby reducing the power requirements to raise the work implement 106 and also reduces the chance of overly displacing the pile of material.

Then, at a step 512, the control module 204 may end the load phase and commence the finish-lift phase. After commencing the finish-lift phase, the sequence may advance to step 506, which includes advancing to step 602 in FIG. 6.

If at step 508, the load phase ending conditions are not met, then the control module 204 may be configured to increase the rim-pull and generate lift and tilt signals at a step 514. This may be accomplished by controlling the clutch 228 within the transmission 118 to increase the power transfer from the engine 116 to the transmission 118, thereby increasing the forward driving force applied to the wheels 112, 114, and likewise increasing the forward or driving force into the pile. Other methods and systems also may be used to reduce the rim-pull. Increasing the rim-pull may further aid in filling the work implement 106 with material.

In addition to controlling the rim pull at step 514, the control module 204 may implement a sequence to control the work implement 106 by generating lift and tilt signals and monitoring the position and/or velocity of the work implement 106 and/or the lift and tilt actuators 108, 110. In one example, the sequence may include operating the tilt actuator 110 to repetitively fluctuate between a high velocity and a low velocity. This repetitive operation is intended to facilitate entry of the work implement 106 into the pile of material. In this example, the control module 204 may generate a first tilt command to tilt the work implement 106 at a desired first velocity, such as a maximum velocity. When the tilt velocity achieves the desired first velocity, the control module 204 may generate a second tilt command to tilt the work implement 106 at a desired second velocity, such as a minimum velocity. When the tilt velocity achieves the desired second velocity, the control module 204 may generate a third command to tilt the work implement 106 at the desired first velocity, and so on, providing repetitive, incremental increases and decreases in velocity as the work implement 106 advances into the pile. Accordingly, the changes may include repetitively increasing and decreasing the tilt velocity of the work implement 106 while advancing into the pile and during loading of the work implement 106.

In another embodiment, the repetitive velocity changes may be implemented based on a monitored position of the work implement 106. For example, the control module 204 may send a tilt command to tilt the work implement 106 at the desired first velocity until the position of the tilt actuator 110 changes a certain pre-selected distance, as detected by the tilt sensor 210. Then, the control module 204 may send a tilt command to tilt the work implement 106 at the desired second velocity until the position of the tilt actuator 110 again changes a certain amount, and so on.

In yet another exemplary embodiment, the repetitive velocity changes may be implemented based on a time at each velocity command. For example, the control module 204 may generate a tilt command to tilt the work implement 106 at the desired first and second velocities for first and second pre-selected periods of time. It should be noted that the control module 204 may generate lift and tilt commands that may be fixed values, may fluctuate between certain limits, may incrementally change or may be smooth increasing or decreasing commands. In addition, the control system may utilize different methods to achieve these forms of commands, such as passing them through control filters before sending them to the implement control 220 or the transmission control 222.

At a step 516, the control module 204 determines whether the work implement 106 is stuck in position due to the toughness of the material pile. The work implement 106 may become stuck when, for example, it becomes embedded in the material pile and the control module 204 determines, based on signals from the lift, tilt, and speed sensors 208, 210, 212, that the lift, tilt, and machine velocity are all below pre-designated threshold values. Accordingly, to determine whether the work implement 106 is stuck at step 516, the control module 204 may consider whether the desired pre-designated velocity of the lift and tilt actuators 108, 110 and the pre-designated velocity of the work machine 100 correspond to the actual velocities of the lift and tilt actuators 108, 110 and the work machine 100. If the actual velocities are less than the desired velocities, the work implement 106 may be stuck within the material pile.

If the work implement 106 is stuck within the pile at a step 516, the control system 204 may generate a pre-designated tilt command, such as a maximum tilt command, at a step 518, in order to break loose the work implement 106 from its stuck position.

If at step 516, the work implement 204 is not stuck, the control module 204 may determine whether a front of the work machine 100 is touching the pile, at a step 520. In one exemplary embodiment, the control module 204 determines that the front of the work machine 100 is touching the pile when the front wheels 112 have advanced to the edge of the pile. Determining whether the front of the work machine 106 is touching the pile may be accomplished based on a determination of the distance that the work machine 100 has traveled since the penetration phase began. For example, the distance traveled can be determined based on signals from the speed sensor 212, and the distance from the front wheels 112 to the work implement 106.

Figure 6:
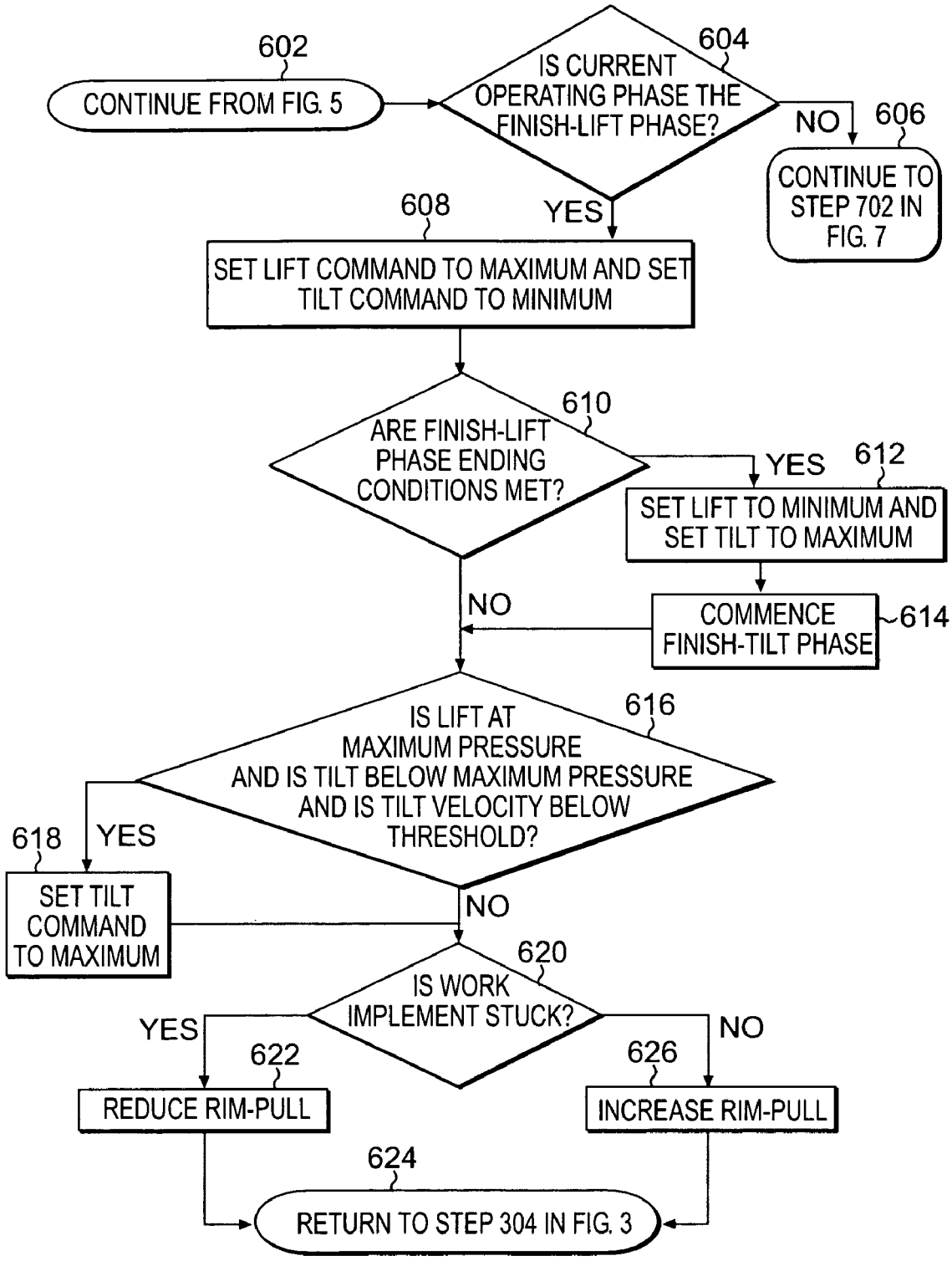
FIG. 6 is a flow diagram showing a finish-lift phase of the exemplary control sequence of the method of digging and loading.

If the front of the work machine 100 is touching the pile at step 520, then the control module 204 may end the load phase and commence the finish-lift phase at step 512, which then continues to step 602 in FIG. 6, at step 506. If, however, the front of the work machine 100 is not touching the pile at step 520, or alternatively, after setting the tilt command to a maximum at step 518, the method may advance to step 522 and may determine whether the work implement 106 is tilting more quickly than desired by comparing the actual tilt velocity to a pre-established threshold velocity.

If the actual tilt velocity exceeds the established threshold velocity, then the control module 204 may generate a tilt command to reduce the tilt velocity to a pre-designated value, such as a minimum or zero value, at step 524. At step 526, the sequence may return to step 304 in FIG. 3 and may repeat. If the actual tilt velocity does not exceed a pre-established velocity at step 522, the sequence also advances to step 526 and returns to step 304 in FIG. 3.

As explained above, if the finish-lift phase has been commenced at step 512 in FIG. 5, or if the current operating phase is not the load phase at step 504, then the method continues to step 602 in FIG. 6. FIG. 6 discloses a finish-lift phase of the control sequence, and continues the method from FIG. 5 at a step 602. At a step 604, the control module 204 queries whether the current operating phase is the finish-lift phase. If the current operating phase is not the finish-lift phase, then the control sequence advances to step 702 in FIG. 7, at a step 606. If, however, the current operating phase is the finish-lift phase, then the lift command is set to a pre-established level, such as a maximum level, and the tilt command is set to a pre-established level, such as a minimum level, at a step 608.

At a step 610, the control module 204 queries whether the finish-lift phase ending conditions are met. The finish-lift phase ending conditions may be determined based on the position of the lift and tilt actuators 108, 110, as determined by the lift and tilt sensors 208, 210. Accordingly, if one or more of the actuators 108, 110 are extended beyond a pre-designated position, the finish-lift phase ending conditions will be met. If the conditions are met, the lift command may be set to zero and the tilt command may be maximized, at a step 612. Then, the control sequence may commence the finish-tilt phase, at a step 614. It should be noted that although the finish-tilt phase is described with reference to FIG. 7, the control sequence will continue through the remainder of the finish-lift phase steps before advancing to FIG. 7 at step 606 during the following method iteration. As explained above, in one exemplary embodiment, the method iterations occur about every 20 milliseconds.

Once the control sequence commences the finish-tilt phase at step 614, or alternatively, if the finish-lift conditions are not met at step 610, the control module 204 queries at a step 516 whether a pressure in the lift actuator 108 is at or is approaching a maximum pressure, whether a pressure within the tilt actuator 110 is at a threshold value substantially below a maximum pressure, and whether the tilt has a velocity less than a pre-established limit. The pressures may be monitored by the pressure sensors 230, 232 associated with the lift and tilt actuators 108, 110. When the pressure in the lift and tilt actuators are at or are approaching a maximum pressure, then the lift and tilt actuators 108, 110 may not be capable of producing any additional movement. This may occur when the load against the work implement 206 is greater than the forces generated by the lift and tilt actuators 108, 110 or when the actuators are fully extended.

If at step 616, the pressure within the lift actuator 108 is at or approaching a maximum, then the lift actuator 108 is unable to produce additional lift. If the pressure within the tilt actuator is less than a maximum amount and/or has a low tilt velocity, then the control module 204 may generate a pre-designated tilt command, such as a maximum command, at a step 618. After step 618, the control module 204 may determine whether the work implement 106 is stuck, at a step 620. Likewise, if at step 616, the conditions are not met, then the control module 204 queries at step 620 whether the work implement 106 is stuck. Again, as explained above, the determination of whether the work implement 106 is stuck may include comparing an actual velocity of the lift and tilt actuators 108, 110, and an actual velocity of the work machine 100, to stored, pre-established threshold velocities. If the work implement 106 is stuck, then the control module 204 may control the clutch 228 to reduce the rim-pull at a step 622. This rim-pull reduction may be useful when the work implement 106 is stuck because it may reduce or eliminate forces on the work implement 106 in the horizontal direction. Therefore, to break-out of a stuck position, the forces applied against the work implement 106 are reduced to only a vertical force. This vertical force, or resistance, may be overcome by the lift provided by the lift actuator 108, enabling the work implement 106 to break-out of its stuck position. The sequence then may return to step 304 in FIG. 3, at a step 624.

If the control module 204 determines that the work implement 106 is not stuck at step 620, the control module 204 may control the clutch 228 to increase the rim-pull at a step 626, thereby further advancing into the material pile. The control sequence will then return to step 304 in FIG. 3, at step 624. As explained above with respect to step 604, if the current operating phase is not the finish-lift phase, then the method continues to step 702 in FIG. 7 at step 606.

Figure 7:
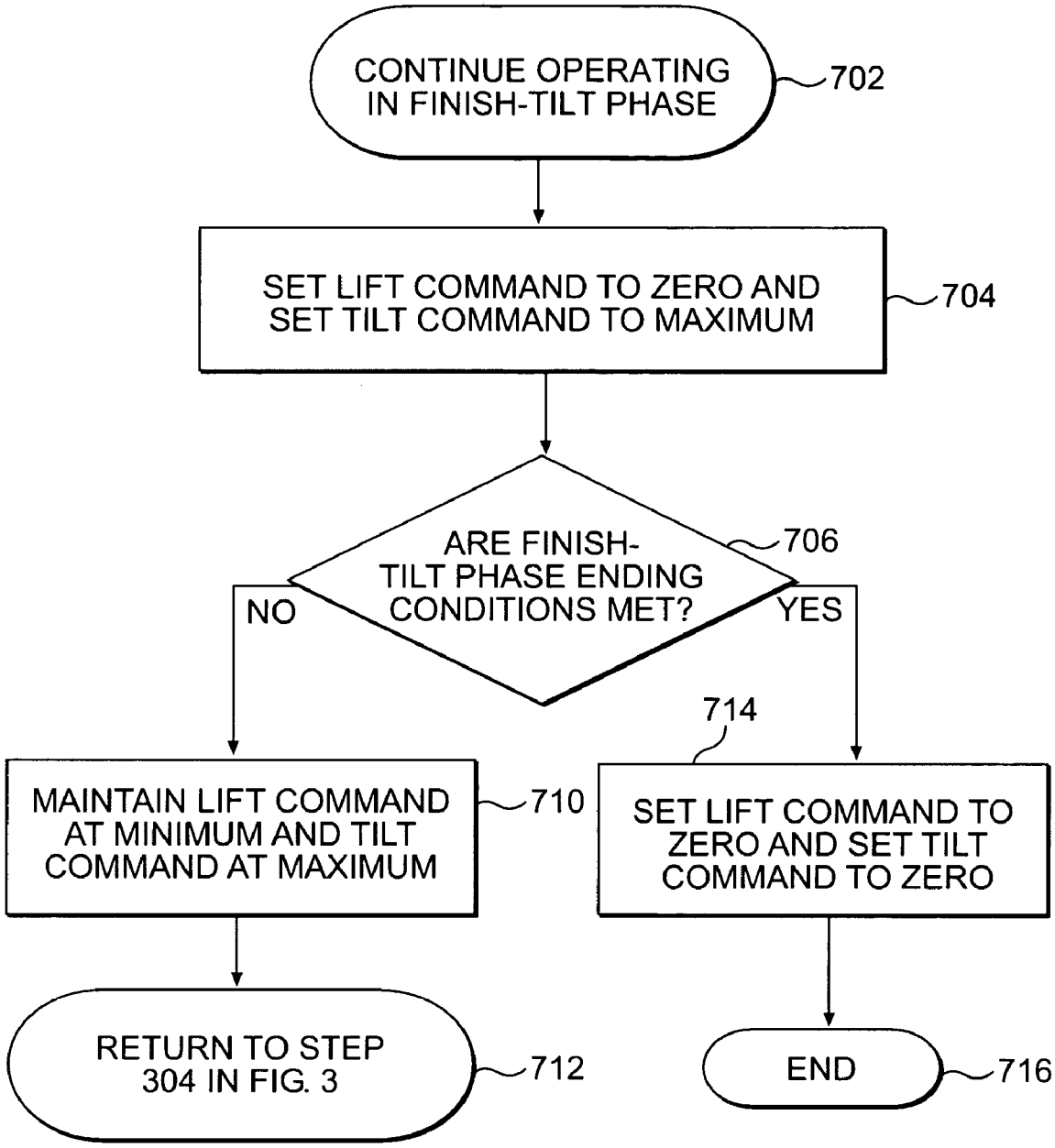
FIG. 7 is a flow diagram showing a finish-tilt phase of the exemplary control sequence of the method of digging and loading.

FIG. 7 discloses the finish-tilt phase of the control sequence. At step 702, the method continues from FIG. 6 and continues to operate in the finish-tilt phase as commenced in step 606. At step 704, the control module 204 sets the lift command to a pre-designated setting, such as a minimum or zero command, and sets the tilt command to a pre-designated setting, such as a maximum command setting. At a step 706, the control module 204 queries whether the finish-tilt phase ending conditions are met. The ending conditions at step 706 are determined by an extension amount of the lift and tilt actuators. If the conditions are not met, the control module 204 maintains the lift command at a zero setting and maintains the tilt command at a maximum setting, at a step 710. At a step 712, the sequence returns to step 304 in FIG. 3. If at step 706, the finish-tilt phase ending conditions are met, then the control module 204 sets the lift command and the tilt command to zero at a step 714. At a step 716, the method ends.

In one exemplary embodiment, the operator may override the control sequence at any time by manipulating the input device 216 to generate an input signal. When this occurs, the control module 204 may be configured to generate a control signal based on the input signal from the input device 216. Further, the control module 204 may be configured to deactivate the control sequence at any time if the operator changes operating gears during the sequence, thereby returning control of the work implement 106 to the operator.

INDUSTRIAL APPLICABILITY

The digging and loading system disclosed herein may provide increased utility to an automatic loading system. The system may be configured to automatically adjust a rim-pull amount, a tilt speed, and/or a lift speed based on at least one current value of monitored velocities. Because of this, the system need not rely solely upon monitored pressures and monitored cylinder positions when advancing through a control sequence. Therefore, the system is more robust and consistent than prior systems and may be particularly useful when digging or loading material from a tough material pile, requiring high force to enter and load the work implement 106. Further, because the system is velocity based rather than pressure or position based, it may not require adjustment or tuning when digging and loading separate materials of different densities and weight.

By adjusting the rim-pull, tilt speed, and lift speed based on at least one current velocity value of the lift actuator, the tilt actuator, or the work machine ground speed, the digging and loading system can responsively maintain an applied force against the work implement 106 in an efficient, productive manner. Therefore, the work machine 100 may be used to achieve high productivity and efficiencies, while simplifying operation.

Although the work machine described herein is a wheel loader, other types of work machines, e.g., track loaders, backhoe loaders, excavators, front shovels, and the like, also may incorporate the digging and loading system. Further, although the lift and tilt actuators are described with reference to lifting and tilting the work implement of a wheel loader, it is contemplated that the lift actuator may be any actuator configured to affect the height of the work implement 106. In addition, it is contemplated that the tilt actuator may be any actuator configured to provide rotational control of the work implement 106. For example, when the system disclosed herein is used on an excavator, the lift actuator may be the actuator associated with either the boom or stick, and the tilt actuator may be the actuator associated with and configured to control rotation of the bucket.

It will be apparent to those skilled in the art that various modifications and variations can be made in the disclosed embodiments without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

We claim:

1. An automatic loading control system for loading an implement of a work machine with material from a pile, comprising:

a lift sensor configured to monitor a lift actuator and communicate a lift signal;

a tilt sensor configured to monitor a tilt actuator and communicate a tilt signal;

a speed sensor configured to communicate a speed signal indicative of a speed of the work machine; and a control module configured to receive the lift signal, the tilt signal, and the speed signal and generate a control signal to control a clutch configured to control a rim-pull of a powered wheel of the work machine based on at least one of a lift velocity of the lift actuator, a tilt velocity of the tilt actuator, and a work machine velocity to facilitate movement of the implement through the pile.

2. The loading control system of claim 1, wherein the control module is configured to determine at least one of the lift velocity, the tilt velocity and the work machine velocity based on the respective lift signal, tilt signal, and speed signal.

3. The loading control system of claim 1, wherein at least one of the lift signal, the tilt signal, and the speed signal are indicative of velocity monitored by the lift sensor, the tilt sensor, and the speed sensor.

4. The loading control system of claim 1, wherein the control module is configured to generate the control signal to reduce the rim-pull when the work machine velocity falls below a pre-designated threshold.

5. The loading control system of claim 4, wherein the control module is configured to generate a tilt command signal to increase the tilt velocity when the work machine velocity falls below a pre-designated threshold.

6. The loading control system of claim 1, wherein the controller is configured to generate a tilt control signal to provide a desired tilt velocity when the lift, tilt, and speed velocities are at or below a pre-designated threshold.

7. The loading control system of claim 1, wherein the control module is configured to detect when a front wheel of the work machine touches a pile of material being loaded in the implement.

8. The loading control system of claim 7, wherein the controller is configured to generate signal to reduce the rim-pull when the front wheel of the work machine touches the pile.

9. The loading control system of claim 1, wherein the control module is configured to generate the control signal to increase the rim-pull when the tilt velocity is above a pre-designated threshold when loading the implement.

10. The loading control system of claim 1, wherein the control module is configured to generate the control signal to decrease the rim-pull when the tilt velocity and the work machine velocity are below pre-designated thresholds when loading the implement.

11. The loading control system of claim 1, wherein the control module is configured to generate the control signal to reduce the rim-pull when the lift and tilt signals indicate that the lift and tilt actuators are extended beyond a pre-designated position.

12. A method of controlling an automatic bucket control system for loading an implement of a work machine with material from a pile, comprising:

monitoring a lift actuator and communicating a lift signal;

monitoring a tilt actuator and communicating a tilt signal;

communicating a speed signal indicative of a speed of the work machine; and generating a control signal to control engagement of a clutch configured to control a rim-pull of a powered wheel of the work machine based on at least one of a lift velocity of the lift actuator, a tilt velocity of the tilt actuator, and a work machine velocity to facilitate movement of the implement through the pile.

13. The method of claim 12, including determining at least one of the lift velocity, the tilt velocity, and the work machine velocity based on the respective lift signal, tilt signal, and speed signal.

14. The method of claim 12, wherein monitoring a lift actuator includes monitoring a velocity of the lift actuator, and wherein monitoring a tilt actuator includes monitoring a velocity of the tilt actuator.

15. The method of claim 12, wherein generating the control signal to control the rim-pull includes generating the control signal to reduce the rim-pull when the work machine velocity falls below a pre-designated threshold.

16. The method of claim 15, further including generating a tilt command signal to increase the tilt velocity when the work machine velocity falls below a pre-designated threshold.

17. The method of claim 12, further including generating a tilt control signal to provide a desired tilt velocity when the lift, tilt, and speed velocities are at or below a pre-designated threshold.

18. The method of claim 12, further including detecting when a front wheel of the work machine touches a pile of material being loaded in the implement.

19. The method of claim 18, further including generating the control signal to reduce the rim-pull when the front wheel of the work machine touches the pile.

20. The method of claim 12, further including increasing the rim-pull when the tilt velocity is above a pre-designated threshold when loading the implement.

21. The method of claim 12, further including decreasing the rim-pull when the tilt velocity and the work machine velocity are below pre-designated thresholds when loading the implement.

22. The method of claim 12, further including reducing the rim-pull when the lift and tilt signals indicate that the lift and tilt actuators are extended beyond a pre-designated position.

23. An automatic loading control system for loading an implement of a work machine, comprising:

a lift sensor configured to monitor a lift actuator and communicate a lift signal indicative of a lift velocity of the implement;

a tilt sensor configured to monitor a tilt actuator and communicate a tilt signal indicative of tilt velocity of the implement;

a speed sensor configured to communicate a speed signal indicative of a speed of the work machine; and a control module configured to receive the lift signal, the tilt signal, and the speed signal and generate a control signal to adjust at least one of the lift velocity, the tilt velocity, and the machine speed based on differences between at least one of the lift velocity and a pre-designated lift velocity, the tilt velocity and a pre-designated tilt velocity, and the machine speed and a pre-designated machine speed, to facilitate entry of the implement into a pile of material while loading the implement.

24. The loading control system of claim 23, wherein the control module is configured to generate the control signal to incrementally decrease at least one of the lift velocity and the tilt velocity when at least one of the lift velocity and the tilt velocity achieves a desired velocity.

25. The loading control system of claim 23, wherein the control module is configured to generate the control signal to incrementally increase at least one of the lift velocity and the tilt velocity when at least one of the lift velocity and the tilt velocity achieves a desired velocity.

26. The loading control system of claim 23, wherein the control module is configured to generate the control signal to incrementally increase or decrease at least one of the lift velocity and the tilt velocity when the implement moves a pre-selected distance.

27. The loading control system of claim 23, wherein the control module is configured to generate the control signal to incrementally increase or decrease at least one of the lift velocity and the tilt velocity when the implement has moved at least one of the lift velocity and the tilt velocity for a pre-selected length of time.

28. A method of controlling an automatic bucket control system for loading an implement of a work machine, comprising:

monitoring a lift actuator and communicating a lift signal indicative of a lift velocity of the implement;

monitoring a tilt actuator and communicating a tilt signal indicative of a tilt velocity of the implement;

communicating a speed signal indicative of a speed of the work machine; and generating a control signal to adjust at least one of the lift velocity, the tilt velocity, and the machine speed based on differences between at least one of the lift velocity and a pre-designated lift velocity, the tilt velocity and a pre-designated tilt velocity, and the machine speed and a pre-designated machine speed, to facilitate entry of the implement into a pile of material while loading the implement.

29. The method of claim 28, wherein generating the control signal includes incrementally decreasing at least one of the lift velocity and the tilt velocity when at least one of the lift velocity and the tilt velocity achieves a desired velocity.

30. The method of claim 28, wherein generating the control signal includes incrementally increasing at least one of the lift velocity and the tilt velocity when at least one of the lift velocity and the tilt velocity achieves a desired velocity.

31. The method of claim 28, wherein generating the control signal includes incrementally increasing or decreasing at least one of the lift velocity and the tilt velocity when the implement moves a pre-selected distance.

32. The method of claim 28, wherein generating the control signal includes incrementally increasing or decreasing at least one of the lift velocity and the tilt velocity when the implement has moved at at least one of the lift velocity and the tilt velocity for a pre-selected length of time.

33. A method for controlling a work machine during loading of an implement with material from a pile of material, the method comprising:

detecting when the implement enters the pile of material;

determining when ground engaging devices of the work machine reach the pile of material by determining a distance traveled by the work machine since the implement entered the pile of material; and generating a signal to effect movement of the implement in response to the determination that the ground engaging devices reached the pile of material.

34. The method of claim 33, including reducing the ground speed of the work machine in response to the determination that the ground engaging devices reached the pile of material.

35. The method of claim 33 wherein determining a distance traveled by the work machine since the implement entered the pile of material includes:

monitoring the velocity of the work machine; and calculating the distance traveled based upon the monitored velocity over time.

36. The method of claim 33, wherein determining when the ground engaging devices of the work machine reach the pile of material includes determining a distance traveled by the work machine since the implement entered the pile of material and comparing the distance traveled to a distance between the ground engaging devices and the implement.

* * * * *